US009289031B2

(12) United States Patent
Sakaue et al.

(10) Patent No.: US 9,289,031 B2
(45) Date of Patent: Mar. 22, 2016

(54) LACING CORD AND SHOES USING THE SAME

(71) Applicant: Shimano Inc., Sakai, Osaka (JP)

(72) Inventors: Atsushi Sakaue, Osaka (JP); Kanji Kirimoto, Osaka (JP)

(73) Assignee: Shimano Inc., Osaka (JP)

( * ) Notice: Subject to any disclaimer, the term of this patent is extended or adjusted under 35 U.S.C. 154(b) by 197 days.

(21) Appl. No.: 14/134,182

(22) Filed: Dec. 19, 2013

(65) Prior Publication Data

US 2014/0196312 A1 Jul. 17, 2014

(30) Foreign Application Priority Data

Jan. 11, 2013 (JP) ..... 2013-003223

(51) Int. Cl.

| | |
|---|---|
| ***A44C 9/00*** | (2006.01) |
| ***A43C 1/06*** | (2006.01) |
| ***A43C 11/16*** | (2006.01) |
| ***A45F 3/00*** | (2006.01) |
| ***A45F 3/04*** | (2006.01) |

(52) U.S. Cl.

CPC ..... *A43C 1/06* (2013.01); *A43C 11/165* (2013.01); *A45F 3/00* (2013.01); *A45F 3/04* (2013.01); *A45F 2003/001* (2013.01); *Y10T 24/37* (2015.01)

(58) Field of Classification Search

None

See application file for complete search history.

(56) References Cited

U.S. PATENT DOCUMENTS

| | | | | | |
|---|---|---|---|---|---|
| 1,066,759 | A * | 7/1913 | Schloss | D04C 1/00 139/421 |
| 3,130,630 | A * | 4/1964 | Dawes | D04D 1/00 174/69 |
| 2011/0266384 | A1 | 11/2011 | Goodman et al. | |
| 2013/0081508 | A1 | 4/2013 | Nishimura et al. | |
| 2013/0081509 | A1 | 4/2013 | Nishimura et al. | |

FOREIGN PATENT DOCUMENTS

| | | | | |
|---|---|---|---|---|
| CH | 291255 | * | 7/1990 | F16H 55/26 |
| JP | 2010-148927 | A | 7/2010 | |

* cited by examiner

*Primary Examiner* — Jack W Lavinder

(74) *Attorney, Agent, or Firm* — Global IP Counselors

(57) ABSTRACT

A lacing cord is used in an article to be laced that includes shoes, clothing and bags. The lacing cord basically includes a core wire and at least one protruding part. The core wire includes at least one wire member. The at least one protruding part is provided to a peripheral section of the core wire so as to intersect with an axial direction of the core wire and to protrude radially outward from the peripheral section of the core wire.

14 Claims, 12 Drawing Sheets

LACING CORD AND SHOES USING THE SAME

CROSS-REFERENCE TO RELATED APPLICATIONS

This application claims priority under 35 U.S.C. §119 to Japanese Patent Application No. 2013-003223, filed Jan. 11, 2013. The entire disclosure of Japanese Patent Application No. 2013-003223 is hereby incorporated herein by reference.

BACKGROUND

1. Field of the Invention

This invention generally relates to a lacing cord used for daily necessities including shoes, clothing, and bags and shoes that use this lacing cord.

2. Background Information

Generally, a lacing cord is used in daily necessities including with shoes, clothing and bags. For example, a lacing cord is conventionally known in skating shoes in which the lacing cord is wound using a winding member (see, for example, Japanese Laid-Open Patent Publication No. 2010-148927). Also, a lacing cord wound on a winding member is conventionally known in sports shoes (see, U.S. Patent Application Publication No. 2011/0266384). The conventional lacing cord is guided to the guide part (e.g., eyelet or the like) of a shoe body. A lacing cord tightens a shoe body by the two ends thereof being engaged with the winding member and the winding member being operated in the winding direction. Also, the tightening of the shoe can be loosened by pulling the winding member in the axial direction to enable removal of the shoe.

SUMMARY

Generally, the present disclosure is directed to various features of a lacing cord used for daily necessities including shoes, clothing, and bags and shoes that use this lacing cord. In the conventional lacing cord, substantial force was necessary to rotate the rotating section in a case when the slide was unfavorable in relation to the guide parts when tightening the lacing cord after putting on a shoe. Also, substantial force was necessary even when tightening the lacing cord manually.

One object of the present invention is to decrease in the force necessary for tightening a lacing cord used to lace an article that needs to be laced.

In accordance with a first aspect of the present disclosure, a lacing cord is provided that is used for daily necessities including with shoes, clothing, and bags. The lacing cord comprises a core wire that includes at least one wire member and at least one protruding part provided to the peripheral section of the core wire such as to intersect with the axial direction of the core wire and to protrude from the peripheral section.

In this lacing cord, the protruding part makes contact with the guide parts (e.g., the eyelets or the like of the shoes) that guide the lacing cord when, for example, tightening the lacing cord of a shoe. Accordingly, the contact area of the guide parts and the lacing cord is minimized, and the force necessary for tightening the article to be laced can be reduced.

In accordance with a second aspect of the present invention, the lacing cord according to the first aspect is configured so that the core wire is formed by twisting together a plurality of pieces of a first wire member. In this case, the core wire is formed by twisting together a plurality of pieces of a wire member. Therefore, the strength of the core wire is enhanced.

In accordance with a third aspect of the present invention, the lacing cord according to the first or second aspect is configured so that the plurality of protruding parts are formed by spirally winding a second wire member made of a synthetic resin on the core wire. In this case, the protruding parts are formed in the direction that intersects with the axial direction just by spirally winding a first wire member made of a synthetic resin on the core wire. Therefore, forming a plurality of protruding parts is made easy.

In accordance with a fourth aspect of the present invention, the lacing cord according to the third aspect is configured so that the synthetic resin is selected from a group comprised of PFA (tetrafluoroethylene perfluoroalkyl vinyl ether copolymer), PEP (tetrafluoroethylene hexafluoropropylene copolymer), PTFE (polytetrafluoroethylene), PE (polyethylene), and POM (polyacctal). In this case, the protruding parts are formed from a synthetic resin with an excellent sliding ability. Therefore, the force for tightening the article to be laced can be decreased further.

In accordance with a fifth aspect of the present invention, the lacing cord according to any one of the first to fourth aspects is configured so that the first wire member is a steel wire. In this case, the strength of the core wire is enhanced.

In accordance with a sixth aspect of the present invention, the lacing cord according to the fifth aspect is configured so that the first wire member is a stainless steel wire. In this case, the corrosion resistance of the core wire is enhanced.

In accordance with a seventh aspect of the present invention, the lacing cord according to the fifth or sixth aspect is configured so that a primer layer is formed on the peripheral section of the core wire. In this case, the core wire made from a steel wire is joined to the protruding parts via a primer layer. Therefore, adhesion of the protruding parts to the core wire is enhanced.

In accordance with an eighth aspect of the present invention, the lacing cord according to any one of the first to fourth aspects is configured so that the first wire member is made from a synthetic resin. In this case, even the first wire member that formed the core wire is made from a synthetic resin. Therefore, reduction in the weight of the lacing cord can be achieved.

In accordance with a ninth aspect of the present invention, a shoe including the lacing cord according to any one of the first to eighth aspects further includes a shoe body and a winding member. The shoe body has a plurality of guide parts that guide the lacing cord. The winding member has a rotating section that tightens the shoe body with the lacing cord by rotating the rotating section and winding the lacing cord.

In this shoe, the shoe body is tightened by winding the lacing cord, which has protruding parts protruding in the direction that intersects with the axial direction, according to a winding member. Here, a lacing cord wherein the protruding parts were provided and the contact area to the guide parts was minimized is used. Therefore, the force for tightening the shoe body can be reduced.

In accordance with a tenth aspect of the present invention, the lacing cord according to the ninth aspect is configured so that the winding member has a release mechanism that loosens the tightness of the shoe. In this case, the tightness of the lacing cord can be loosened when removing the shoe. Therefore, the shoe can be removed easily.

According to the lacing cord disclosed in the present disclosure, the contact area between the guide parts and the lacing cord is minimized, and the force necessary for tightening the article to be laced can be reduced.

Also other objects, features, aspects and advantages of the disclosed lacing cord will become apparent to those skilled in the art from the following detailed description, which, taken in conjunction with the annexed drawings, discloses one embodiment of the lacing cord.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the bicycle field from this disclosure that the following descriptions of the embodiments are provided for illustration only and not for the purpose of limiting the invention as defined by the appended claims and their equivalents.

Figure 1:
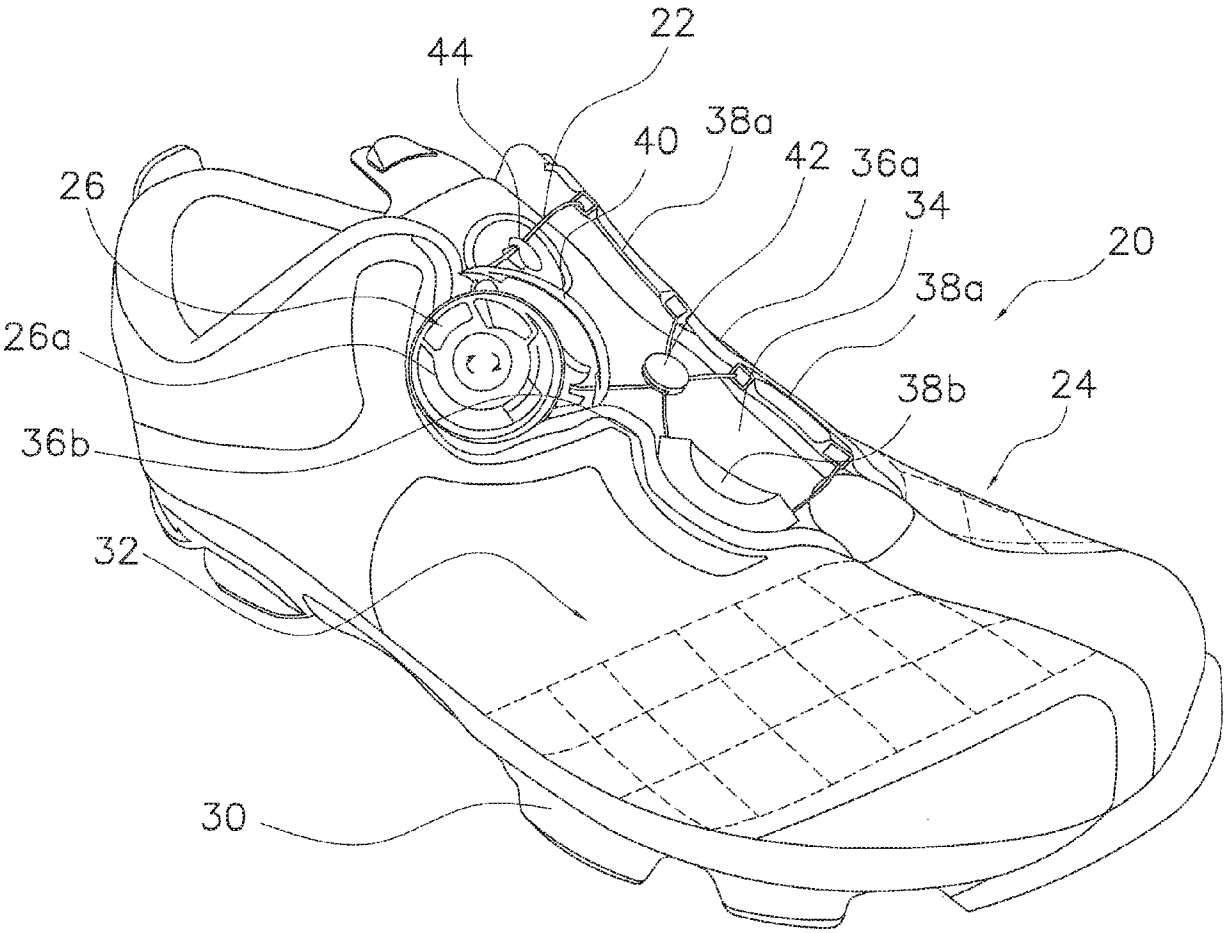
FIG. 1 is a perspective view of a shoe as an article that is to be laced with a lacing cord in accordance with a first embodiment.
Figure 2:
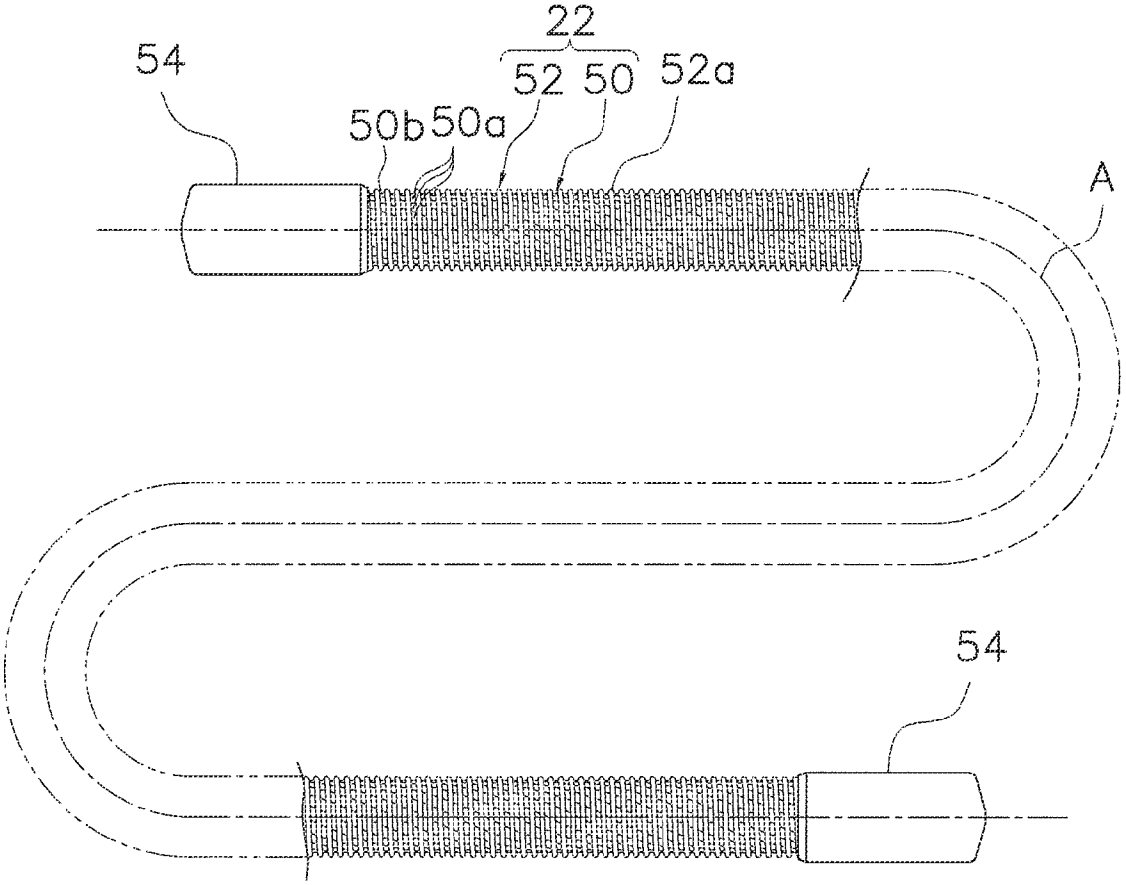
FIG. 2 is a top plan view of the lacing cord in accordance with the first embodiment.
Figure 3:
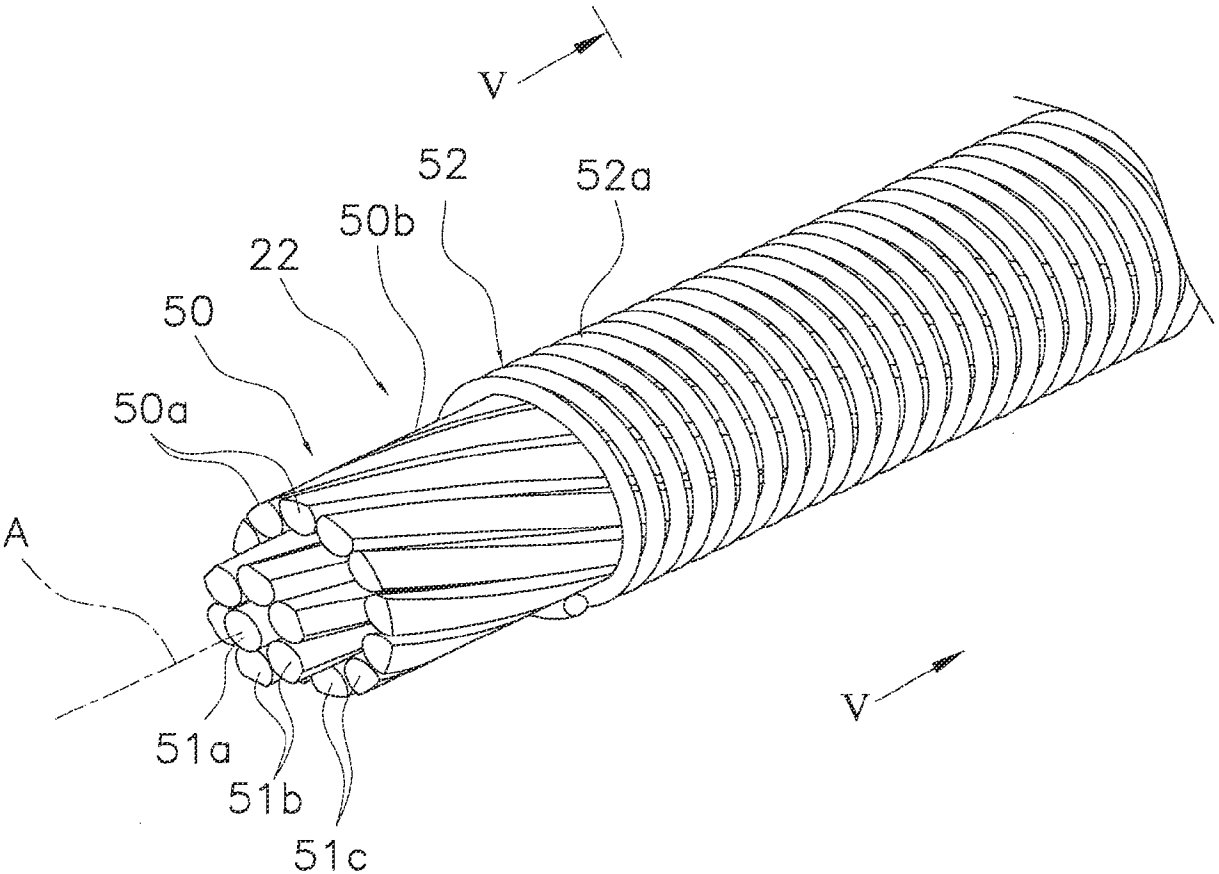
FIG. 3 is an enlarged perspective view of a portion of the lacing cord illustrated in FIGS. 1 and 2.

As seen in FIG. 1, a shoe 20 is illustrated in accordance with a first embodiment. Here, the shoe 20 is a bicycle shoe having a cleat (not shown in the drawing), which can be attached to a binding of a bicycle pedal. The shoe 20 includes, among other things, a lacing cord 22 in accordance with first embodiment, a shoe body 24, and a winding member 26 for tightening the shoe body 24 with the lacing cord 22. Also, the shoe body 24 includes a shoe bottom part 30 and an upper part 32 that covers the shoe bottom part 30. The upper part 32 has a tongue-like portion 34 and a pair of (left and right) flaps 36*a* and 36*b*. The flaps 36*a* and 36*b* extends in a longitudinal direction of the shoe 20. The flaps 36*a* and 36*b* partially cover the tongue-like portion 34. Left and right as described here refer to the left side and the right side when the shoe 20 is viewed from the rear. Also, the shoe body 24 has two first guide parts 38*a* and one second guide part 38*b*. The first guide parts 38*a* are attached to the flap 36*a* on the left side (the back side in FIG. 1). The second guide part 38*b* is attached to the flap 36*b* on the right side. The first guide parts 38*a* are spaced apart from each other along the longitudinal direction of the tongue-like portion 34. The first guide parts 38*a* and the second guide part 38*b* guide the lacing cord 22 along the longitudinal direction of the tongue-like portion 34.

The winding member 26 is disposed to the right side flap 36*b* along one side of the tongue-like portion 34 and spaced rearward of the second guide part 38*b*. The ends of the lacing cord 22 are attached to the winding member 26. The winding member 26 has a rotating section 26*a*. The flaps 36*a* and 36*b* of the shoe body 24 are moved together in an approaching direction by turning the rotating section 26*a* in, for example, the clockwise direction in FIG. 1 for winding the lacing cord 22. Accordingly, in this way, the lacing cord 24 is tightened. The winding member 26 comprises a cord winding section, a one-way clutch that inhibits the rotation of the cord winding section in the winding cancellation direction, and a release mechanism for canceling the activation of the one-way clutch. The release mechanism cancels the activation of the one-way clutch by pulling the rotating section 26*a* axial upwards in relation to the rotation center axis. Accordingly, the tightening of the lacing cord 22 is cancelled. A third guide part 40 is disposed adjacent to the winding member 26 to guide the lacing cord 22 smoothly to the winding member 26. The third guide part 40 is curved into an arc-shape.

The tongue-like portion 12*a* includes an intersecting guide part 42 and a lifting guide part 44. The intersecting guide part 42 guides the lacing cord 20 so as to intersect. The lifting guide part 44 is disposed on the tongue-like portion 12*a* above and rearward of the intersecting guide part 42. The lifting guide part 44 is disposed to be more on the extreme end side of the tongue-like portion 34 than the winding member 26. The lifting guide part 44 lifts up the extreme end side of the tongue-like portion 34 by tightening the lacing cord 22. Accordingly, sagging of the tongue-like portion 34 is prevented. Making the first guide part 38*a*, the second guide part 38*b*, the third guide part 40, the intersecting guide part 42 and the lifting guide part 44 from a hard synthetic resin with excellent sliding ability and abrasion resistance is preferable.

Figure 4:
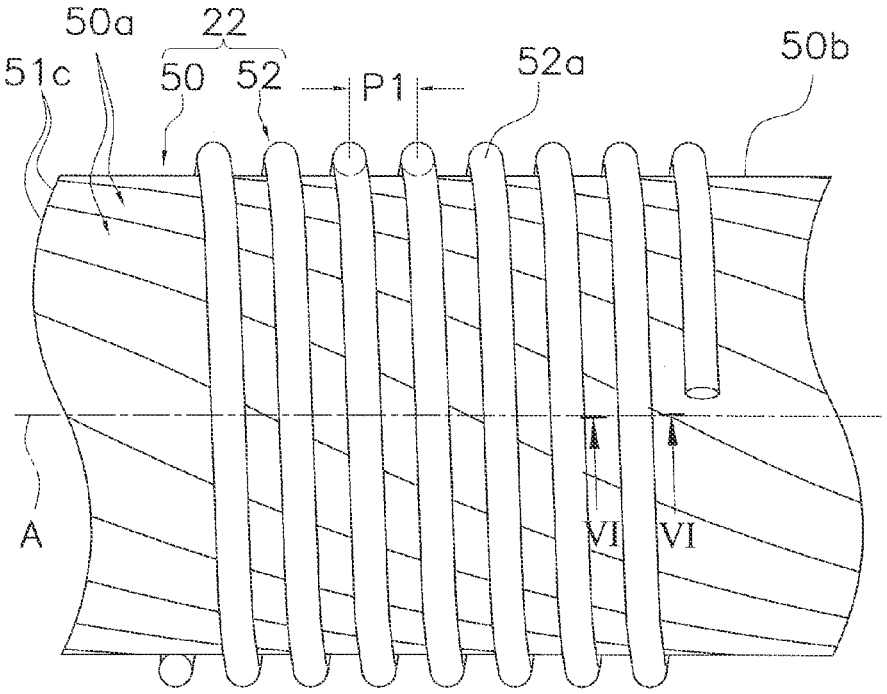
FIG. 4 is an enlarged side elevational view of a portion of the lacing cord illustrated in FIG. 3.
Figure 5:
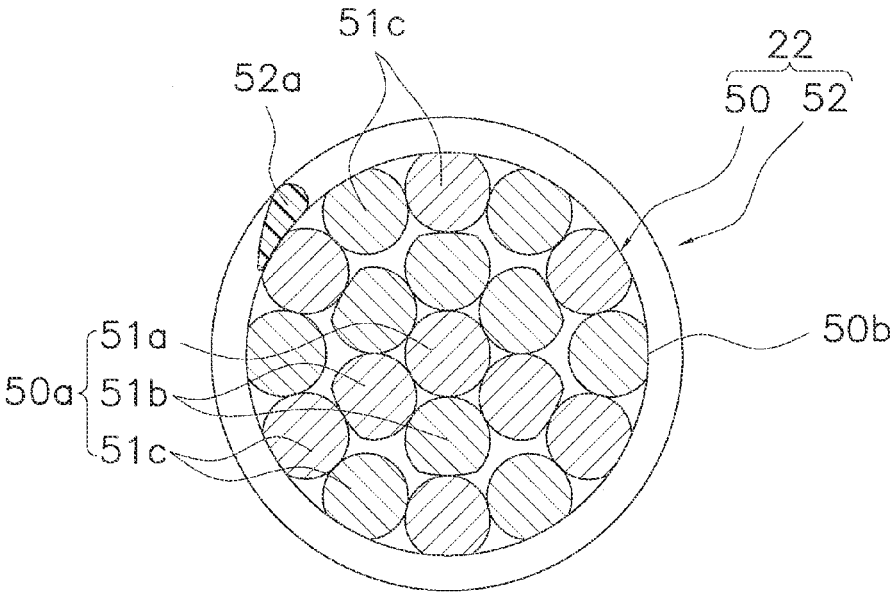
FIG. 5 is a cross-sectional view of the lacing cord illustrated in FIGS. 1 to 4 as seen along section line V-V in FIG. 3.

As illustrated in FIGS. 2 to 5, the lacing cord 22 includes a core wire 50 that includes at least one first wire member 50*a* and at least one protruding part 52. In this embodiment, the core wire 50 is formed by twisting together a plurality of strands (for example, 19 strands) to form the first wire member 50*a*. The first wire member 50*a* is, for example, a steel wire. Preferably, the first wire member 50*a* is made of a stainless steel. The number of strands for the first wire member 50*a* is suitably determined according to the article to be laced. The first wire member 50*a* of the core wire 50 is preferably formed by twisting together a plurality of strands. In this embodiment, the strands of the first wire member 50*a* include a single center strand or wire member 51*a*, a plurality of middle strands or wire members 51*b* and a plurality of outer strands or wire members 51*c*. Here, for example, as illustrated in FIG. 5, there are six of the middle wire members 51*b*, while there are twelve of the outer wire members 51*c*.

The middle wire members 51*b* are twisted together so as to be spirally wound on the center wire member 51*a*. The peripheral surfaces of the middle wire members 51*b* are processed into arc-shapes using a suitable drawing tool after they are twisted together. The outer wire members 51*c* are twisted together onto the middle wire member 51*b*. The peripheral surfaces of the outer wire members 51*c* is processed into arc-shapes using a suitable drawing tool after they are twisted together. The peripheral section 50*b* of the core wire 50 is determined by the peripheral surfaces of the outer wire members 51*c*.

Figure 6:
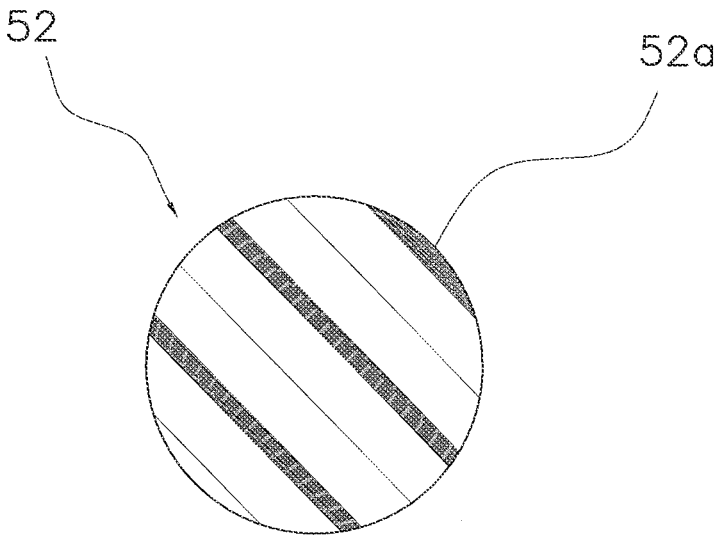
FIG. 6 is a cross-sectional view of the second wire of the lacing cord illustrated in FIGS. 1 to 5 as seen along section line VI-VI in FIG. 4.

The protruding part 52 is provided to make the lacing cord 22 easy to slide against the first guide part 38*a*, the second guide part 38*b*, the third guide part 40, the intersecting guide part 42 and the lifting section 44. The protruding part 52 is disposed to the peripheral section 50*b* of the core wire 50 so as to intersect with the axial direction A of the core wire 50. The protruding part 52 protrudes radially outwards from the peripheral section 50*b* of the core wire 50. In this embodiment, the protruding part 52 has a cross section that has a circular shape as illustrated in FIG. 6. The protruding part 52 is formed by helically winding the single piece of a second wire member 52*a*. The second member 52*a* is made from a synthetic resin that is helically or spirally wound on the core wire 50 as illustrated in FIG. 4. The protruding part 52 is attached to the core wire 50 by, for example, a method such as room temperature adhesion, hot welding, or the like. Accordingly, the protruding part 52 is fixed to the core wire 50 so that relative displacement does not occur therebetween. By helically winding at least one piece of the second wire member 52*a* on the core wire 50 as described above, the protruding part 52 is provided so as to intersect with the axial direction A when viewed two-dimensionally.

To reduce the slide resistance in relation to the first guide part 38*a*, the second guide part 38*b*, the third guide part 40, the intersecting guide part 42 and the lifting section 44, the material used for the protruding part 52 is preferably a material with a lower coefficient of fiction than that of the core wire 50. In this embodiment, the protruding part 52 is made from a synthetic resin. The synthetic resin is preferably selected from a group comprised of PFA (tetrafluoroethylene-perfluoroalkyl vinyl ether copolymer 9), FEP (tetrafluoroethylene-hexafluoropropylene copolymer), PTFE (polytetrafluoroethylene), PE (polyethylene), and POM (polyacetal). The pitch P1 of the protruding part 52 is 1 mm or less, preferably, 500 μm or less and, more preferably, 150 μm or less.

Preferably, a cap member 54 is fixed to the both ends of the lacing cord 22 by a fixation method based on plastic deformation, for example, crimping or the like. The lacing cord 22 is passed through the first guide part 38*a*, the second guide part 38*b*, the third guide part 40, the intersecting guide part 42 and the lifting section 44 in a crisscrossing pattern. Both ends of the lacing cord 22 are fixed to the cord winding section of the winding member 26.

In the lacing cord 22 configured as described above, a foot is inserted into the shoe body 24 in a loosened state according to the lacing cord 22 by pulling the rotating section 26*a* of the winding member 26 to the axial upward side. When the foot is inserted into the shoe body 24, the rotating section 26*a* of the winding member 26 is pressed to the bottom side, and the one-way clutch is set to the activated state. Then, when the rotating section 26*a* is rotated in the clockwise direction, the two end sections of the lacing cord 22 are wound to the cord winding section, the flaps 36*a* and 36*b* of the shoe body 24 approach each other, and the shoe body 24 is tightened on the foot according to the lacing cord 22. At this time, the protruding part 52 that intersect with the axial direction A is provided to the lacing cord 22. Thus, the lacing cord 22 slides smoothly on the guide parts, such as the first guide part 38*a*, the second guide part 38*b*, the third guide part 40, the intersecting guide part 42, and the lifting section 44. Accordingly, the force necessary for the tightening operation that rotates the rotating section 26*a* can be reduced.

Second Embodiment

Figure 7:
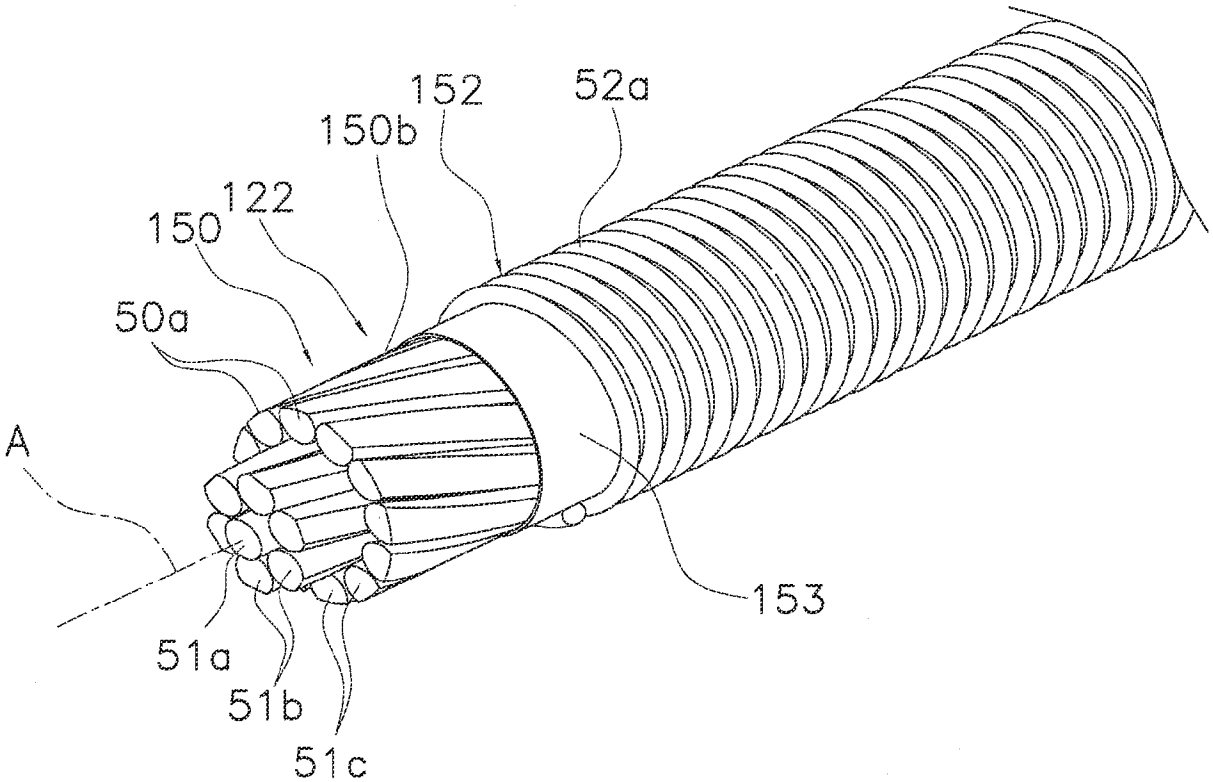
FIG. 7 is an enlarged perspective view, similar to FIG. 3, of a portion of a lacing cord in accordance with a second embodiment 3.

In the second embodiment, as seen in FIG. 7, a lacing cord 122 is illustrated. Here, the lacing cord 122 has a core wire 150, a protruding part 152 and a primer layer 153. The core wire 150 of the lacing cord 122 has a peripheral section 150*b* that is covered with a primer layer 153 as illustrated in FIG. 7. The protruding part 152 is spirally wound on the core wire 150 via the primer layer 153. The primer layer 153 is provided to enhance the adhesion of the core wire 150 to the protruding part 152 and to strengthen the adhesion of the protruding part 152.

Other Embodiments

Embodiments of the present invention were described above. However, the present invention is not limited to these embodiments, and various changes are possible in a scope of not deviating from the essence of the invention. In particular, the embodiments and modified examples described in the specification can be optionally combined according to the need to do so.

(a) In the embodiments described above, the lacing cord is tightened according to a winding member. However, the present invention is not limited to this. The present invention can also be applied to a lacing cord that is tightened manually.

Figure 8:
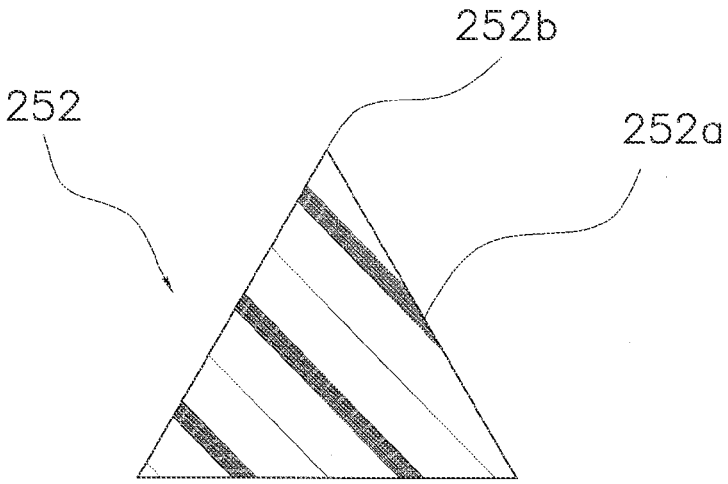
FIG. 8 is a cross-sectional view similar to FIG. 6, of a modified example of the second wire in accordance with another embodiment.
Figure 9:
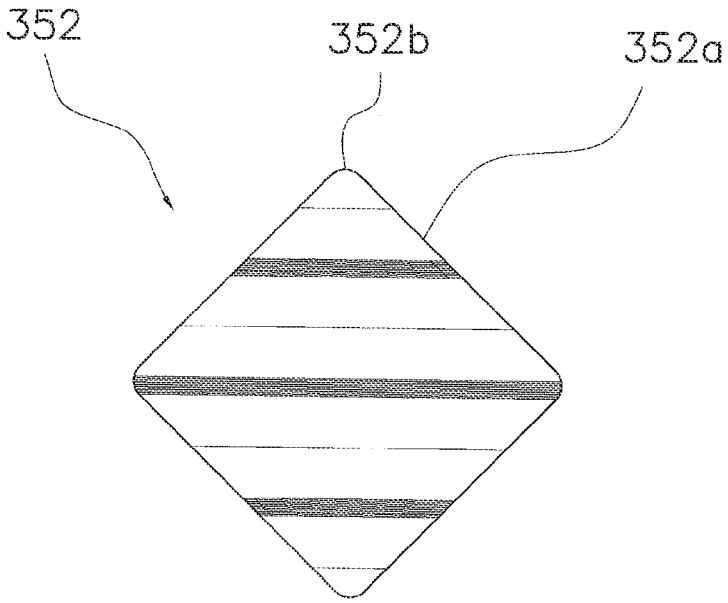
FIG. 9 is a cross-sectional view similar to FIG. 6, of a modified example of the second wire in accordance with yet another embodiment.
Figure 10:
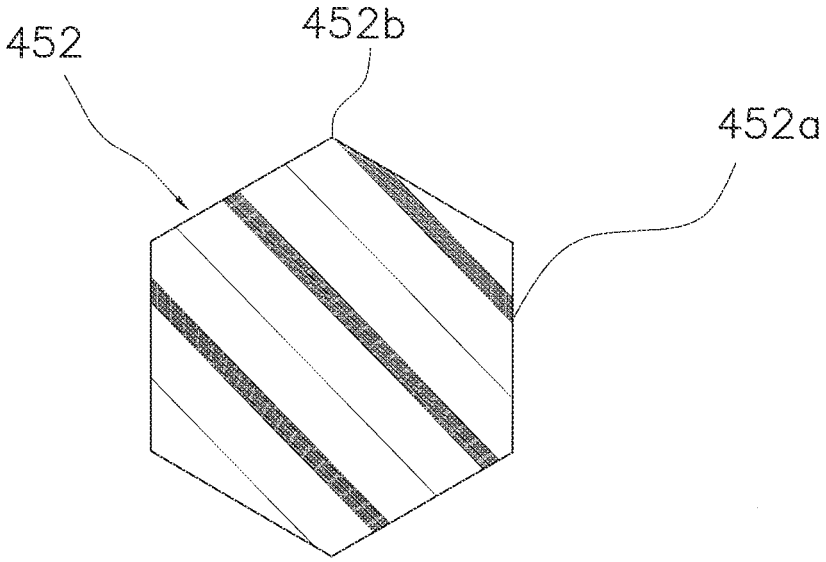
FIG. 10 is a cross-sectional view similar to FIG. 6, of a modified example of the second wire in accordance with yet another embodiment.
Figure 11:
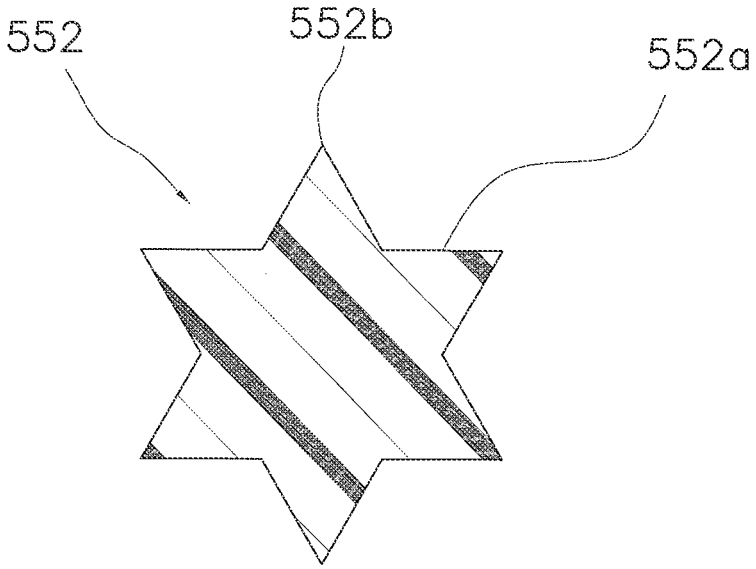
FIG. 11 is a cross-sectional view similar to FIG. 6, of a modified example of the second wire in accordance with yet another embodiment.

(b) In the second embodiment, the cross-sectional shape of the second wire member that forms the protruding part had a circular shape. However, the cross-sectional shape of the second wire member is not limited to a circular shape and can be a non-circular shape such as an elliptical shape, a polygonal shape, or the like. For example, the cross section of the second wire member 252*a* in the protruding part 252 has a triangular shape as illustrated in FIG. 8. The cross section of the second wire member 252*a* of the second wire member 352*a* in the protruding part 352 has a square shape as illustrated in FIG. 9. The cross section of the second wire member 452*a* in the protruding part 452 has a hexagonal shape as illustrated in FIG. 10. The cross section of the second wire member 452*a* in the protruding part 552 has a star shape as illustrated in FIG. 11. In the cross sections of the non-circular shapes described above, unlike the two embodiments described above, angular sections 252*b*, 352*b*, 452*b*, and 552*b* are formed. The area that makes contact with the first guide part 38*a*, the second guide part 38*b*, the third guide part 40, the intersecting guide part 42, and the lifting section 44 is further minimized according to these angular sections 252*b*, 352*b*, 452*b*, and 552*b*. Accordingly, the force necessary in the tightening operation of the article to be laced can be reduced further. Furthermore, like in the core wire, the protruding part can be configured by twisting together a plurality of pieces of the second wire member.

Figure 12:
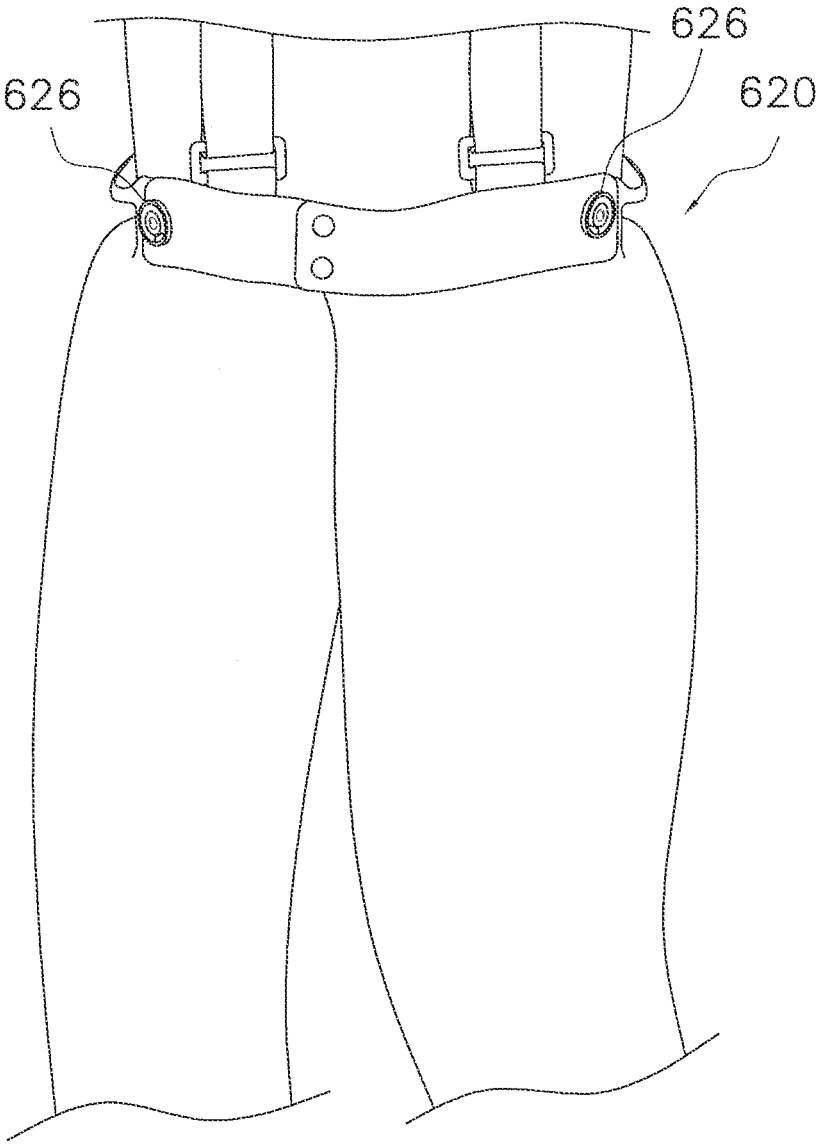
FIG. 12 is a perspective view of a lacing cord in accordance with yet another embodiment in which the lacing cord is applied to rain pants as clothing.

(c) In the embodiments described above, a bicycle shoe was given as an example of the article to be laced. However, the present invention can also be applied to rowing shoes, other sports shoes, shoes used daily, or the like. Furthermore, as the article to be laced, the present invention can be applied to the entire article to be laced that is tightened with the lacing cord 22, including the clothing illustrated in FIG. 12 to FIG. 14 and the bag illustrated in FIG. 15. In FIG. 12, the rain pants 620 as clothing is provided with a winding member 626 on two side sections in the waist area. The waist area can be tightened with the respective winding member 626. A lacing cord not shown in the Figure is arranged on two side sections in a rectangular loop shape, and the two end sections of the lacing cord are wound according to the respective winding member 626. Accordingly, the size of the two side sections can be adjusted according to the size of the waist of the wearer.

Figure 13:
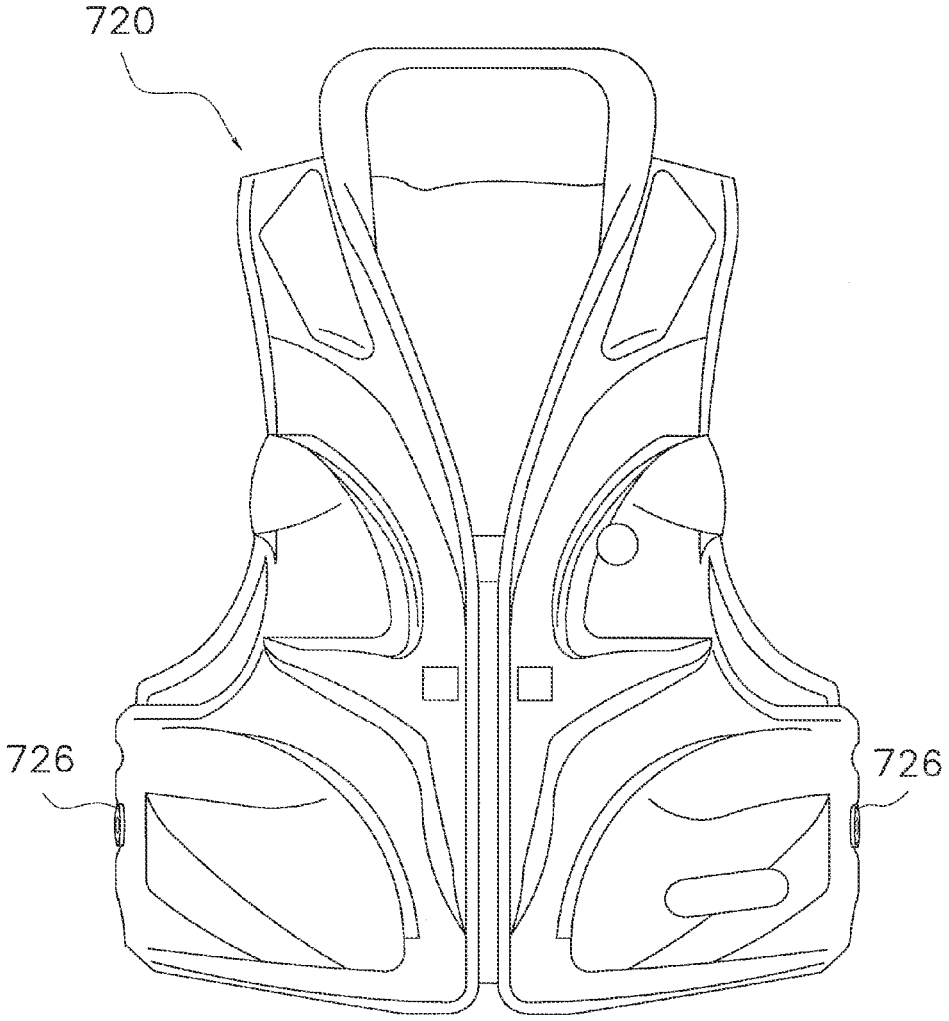
FIG. 13 is a frontal elevational view of a lacing cord in accordance with yet another embodiment in which the lacing cord is applied to a vest as clothing.
Figure 14:
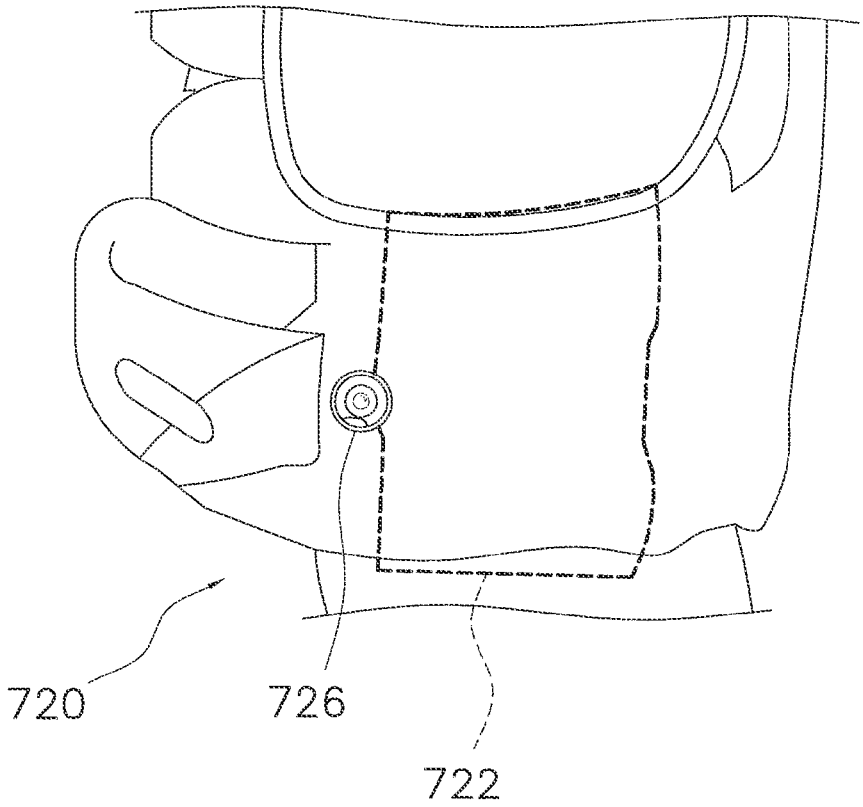
FIG. 14 is a partial side elevational view of the vest illustrated in FIG. 13.

In FIGS. 13 and 14, a vest 720 as clothing is provided with a winding member 726 at the two side sections. A lacing cord 722 is provided to the winding member 726 with the two side sections in a rectangular loop shape, and the two ends of the lacing cord 722 are wound by the respective winding member 726 such that the two side sections of the vest 720 are tightened. Accordingly, the size of the two side sections of the vest can be adjusted according to the size of the wearer.

Figure 15:
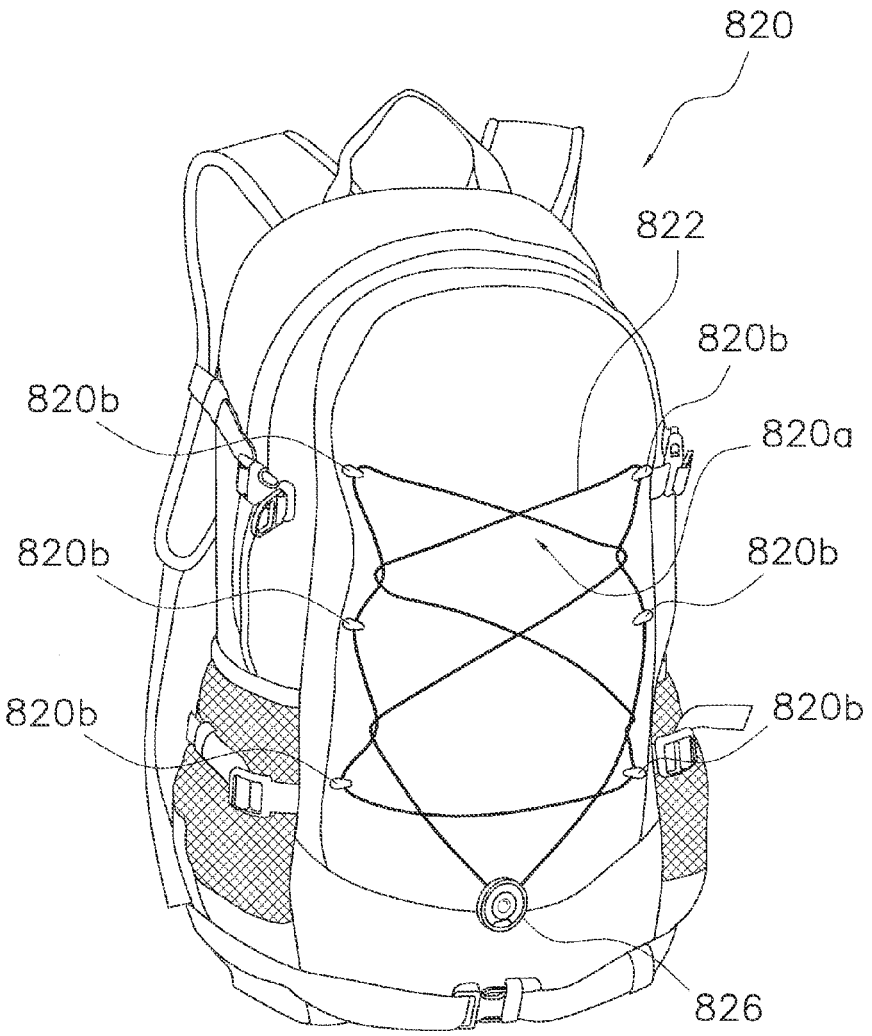
FIG. 15 is a perspective view of a knapsack as a bag in yet another embodiment.

In a backpack 820 as the bag illustrated in FIG. 15, a winding member 826 is provided at the bottom section of the back portion 820*a*. A plurality of (for example, 3) guide parts 820*b* are disposed vertically to the two side sections of the back portion 820*a* by being spaced apart from each other to guide a lacing cord 822. The lacing cord 822 is configured into a mesh pattern by being passed through the guide parts 820*b*. The two ends of the lacing cord 822 are wound onto the winding member 826. Here, various gears such as bolts or the like can be mounted to the backpack 820 by using a lacing cord 822 and tightening the back portion 820*a* with the lacing cord 822.

(d) In the embodiments described above, a steel wire and a stainless steel wire made of metal were given as examples for the first wire member. However, the first wire member can also be made from a synthetic resin.

(e) In the embodiments described above, the present invention was explained by taking shoes, clothing, and a bag as examples of the articles to be laced. However, the articles to be laced applied with the lacing cord of the present invention are not limited to those articles described above. For example, the lacing cord can be applied to stationary, furniture, such as a desk, a shelf, a chair, or the like, and a load carrying platform of automobiles and motorcycles, or the like.

(f) In the embodiments described above, the protruding part was formed by winding one piece of the second wire member. However, it is possible to wind a plurality of pieces of the second wire member. In such cases, the size (for example, the diameter) of the a plurality of pieces of the second wire member can be varied.

(g) In the embodiments described above, the protruding part was configured from the second wire member made of a synthetic resin. However, the second wire member can be made from a metal.

While only selected embodiments have been chosen to illustrate the present invention, it will be apparent to those skilled in the art from this disclosure that various changes and modifications can be made herein without departing from the scope of the invention as defined in the appended claims. Thus, the foregoing descriptions of the embodiments according to the present invention are provided for illustration only, and not for the purpose of limiting the invention as defined by the appended claims and their equivalents.

What is claimed is:

1. A lacing cord for daily necessities including with shoes, clothing and bags, the lacing cord comprising:

a core wire including at least one first wire member; and at least one protruding part including a second wire member that is spirally wound on the core wire, the second wire member being provided to a peripheral section of the core wire so as to intersect with an axial direction of the core wire and to protrude radially outward from the peripheral section of the core wire, the protruding part having a maximum pitch of 1 mm.

2. The lacing cord according to claim 1, wherein the first wire member of the core wire includes a plurality of wire members that are spirally wound.

3. The lacing cord according to claim 1, wherein the protruding is made of a synthetic resin.

4. The lacing cord according to claim 3, wherein the synthetic resin is selected from a group consisting of PEA (tetrafluoroethylene-perfluoroalkyl vinyl ether copolymer), FEP (tetrafluoroethylene-hexafluoropropylene copolymer), PTFE (polytetrafluoroethylene), PE (polyethylene), and POM (polyacetal).

5. The lacing cord according to claim 1, wherein the first wire member is a steel wire.

6. The lacing cord according to claim 5, wherein the first wire member is a stainless steel wire.

7. The lacing cord according to claim 5, wherein the peripheral section of the core wire has a primer layer and the protruding part overlies the primer layer.

8. The lacing cord according to claim 1, wherein the first wire member is made from a synthetic resin.

9. A shoe including the lacing cord according to claim 1, the shoe comprising:

a shoe body having a plurality of guide parts that guide the lacing cord; and a winding member that has a rotating section that tightens the shoe body with the lacing cord by rotating the rotating section for winding the lacing cord.

10. The shoe according to claim 9, wherein the winding member controls a tightness of the lacing cord.

11. The lacing cord according to claim 1, wherein the itch of the protruding part is equal to or less than 500 μm.

12. The lacing cord according to claim 1, wherein the pitch of the protruding part is equal to or less than 150 μm.

13. The lacing cord according to claim 1, wherein the core wire includes at least one metallic strand defining a radially outermost surface of the core.

14. The lacing cord according to claim 1, wherein the at least one first wire member includes a center strand, a plurality of middle strands arranged to circumferentially surround the center strand, and a plurality of outer strands arranged to circumferentially surround the plurality of middle strands.

* * * * *